US007140068B1

(12) United States Patent
Vander Baan et al.

(10) Patent No.: US 7,140,068 B1
(45) Date of Patent: Nov. 28, 2006

(54) VACUUM CLEANER WITH CYCLONIC SEPARATION

(75) Inventors: Gabriel S. Vander Baan, Grand Rapids, MI (US); Gary A. Kasper, Grand Rapids, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 478 days.

(21) Appl. No.: 10/248,677

(22) Filed: Feb. 7, 2003

Related U.S. Application Data

(60) Provisional application No. 60/355,322, filed on Feb. 8, 2002.

(51) Int. Cl.
*A47L 5/28* (2006.01)
*A47L 9/16* (2006.01)

(52) U.S. Cl. ..... 15/347; 15/350; 15/353

(58) Field of Classification Search ..... 15/347, 15/350–353; 55/337, 372, 426, 429, 459.1, 55/DIG. 2, DIG. 3
See application file for complete search history.

(56) References Cited

U.S. PATENT DOCUMENTS 2,467,652 A * 4/1949 Beede ..... 434/370
2,542,634 A * 2/1951 Davis et al. ..... 55/426
2,824,335 A * 2/1958 Moffat ..... 15/345
2,849,080 A 8/1958 Enright
3,200,568 A * 8/1965 McNeil ..... 96/195
3,675,401 A 7/1972 Cordes
4,944,780 A 7/1990 Usmani
5,145,499 A 9/1992 Dyson
5,248,323 A 9/1993 Stevenson
5,254,147 A 10/1993 Finke
6,146,434 A * 11/2000 Scalfani et al. ..... 55/334
6,195,835 B1 * 3/2001 Song et al. ..... 15/327.1
6,256,833 B1 * 7/2001 Steinberg ..... 15/325
6,766,558 B1 * 7/2004 Matsumoto et al. ..... 15/353
6,868,578 B1 * 3/2005 Kasper et al. ..... 15/347
2002/0062632 A1 * 5/2002 Oh ..... 55/337
2002/0092283 A1 * 7/2002 Oh et al. ..... 55/429

FOREIGN PATENT DOCUMENTS

WO WO 97/12660 * 4/1997
WO WO 01/05291 * 1/2001

* cited by examiner

*Primary Examiner*—Terrence R. Till
(74) *Attorney, Agent, or Firm*—McGarry Bair PC

(57) ABSTRACT

A cyclone outlet assembly with a frusto-conical dirt blocking plate minimizes clogging at the outlet of the cyclone separator. An upright vacuum cleaner with a cyclone separator is mounted on and in fluid communication with an elongated rigid tube that forms part of a working air conduit and also forms part of an upright handle that is pivotally mounted to a base module with a suction nozzle upstream from a conventional bag filter in a dirty air or clean air dust collection vacuum cleaner.

18 Claims, 9 Drawing Sheets

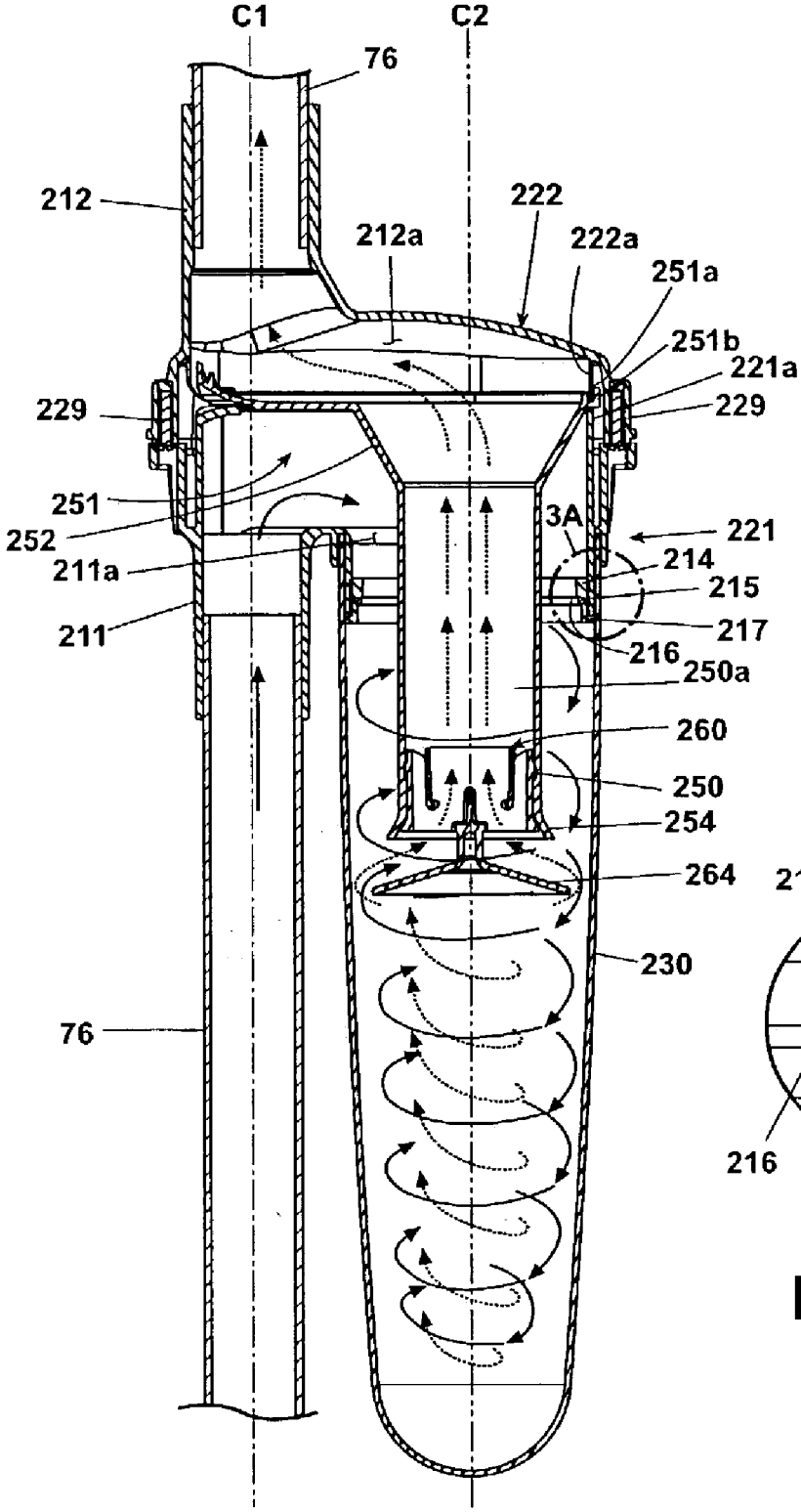
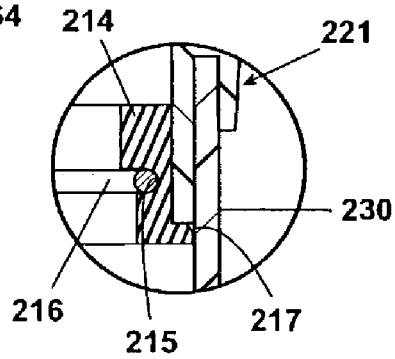
Fig. 3A
Fig. 3

VACUUM CLEANER WITH CYCLONIC SEPARATION

CROSS REFERENCE TO RELATED APPLICATIONS

This application claims the benefit of U.S. Provisional application Ser. No. 60/355,322, filed Feb. 8, 2002, which is incorporated herein by reference in its entirety.

BACKGROUND OF INVENTION

1. Field of the Invention

This invention relates to vacuum cleaners. In one of its aspects, the invention relates to a vacuum cleaner that includes a cyclone dirt separator. In another of its aspects, the invention relates to a vacuum cleaner that incorporates a cyclone separator in combination with a filter bag for dust collection.

2. State of the Prior Art

Upright vacuum cleaners include a handle mounted to a base for pivotal movement between an inclined use position and a generally vertical storage position. Such an upright vacuum cleaner is disclosed in U.S. Pat. No. 6,256,833 issued Jul. 10, 2001. The disclosed upright vacuum cleaner includes a suction nozzle in the base and an agitation brush in the suction nozzle, the suction nozzle being fluidly connected to a suction source and a filter bag enclosure mounted to the handle of the cleaner. Soil from a surface being cleaned is entrained in an airflow from the suction nozzle and transported to the filter bag enclosure for deposit in a semi-permeable filter bag, as is well known in the art. A filter bag is generally disposable, and requires frequent replacement when it becomes full. The effectiveness of some vacuum cleaners decreases prior to the filter bag becoming full, as fine particles trapped by the filter bag degrade its permeability and cause a loss of suction deliverable to the suction nozzle.

Vacuum cleaners using a cyclone separator have the advantage of not requiring replacement of the disposable, non-reusable, filter bag. However, in order to match the dirt capacity of a filter bag-type vacuum cleaner, the cyclone-type vacuum cleaner is usually fairly large to accommodate the generally cylindrical cyclone separation chamber. As the diameter of the cyclone chamber increases, the rotational velocity of the air decreases for a give size vacuum motor. This lower velocity adversely affects the efficiency of the cyclone separator. The large dirt reservoir is also cumbersome to handle while still requiring frequent emptying to avoid re-entrainment of collected dirt into the suction airstream. Decreasing the size of the cyclone chamber could increase its efficiency and ease of handling, but at the cost of further decreasing its capacity to hold dirt when compared to the filter bag-type cleaner.

U.S. Pat. No. 6,146,434 issued Nov. 14, 2000, to Scalfani et al. discloses a stick vacuum cleaner having a floor engaging base with a nozzle opening, a handle pivotally mounted to the base and including a working air conduit from the base to a dirt cup that has cyclonic action to separate entrained dust from the air, a filter bag that covers the outlet from the dirt cup and a suction source above the filter bag to draw the dirty air from the nozzle opening through the cyclonic dirt cup assembly and through the filter bag. The "stick" vacuum disclosed is limited by weight in the strength of suction motor it can accommodate.

PCT published patent application No. WO 84/02282 discloses a dust collector that includes a cyclone separator that communicates with a hose or flexible tubing with a suction nozzle at one end to separate coarse particles from the air. The outlet from the cyclone separator is connected to a bag filter for removing less coarse particles. A suction fan draws air through the cyclone separator and through the bag filter.

U.S. Pat. No. 6,195,835 discloses a canister vacuum cleaner in which a small cyclone dust-collecting device is mounted to a wand for separating and collecting dust and dirt of comparatively large particle size from the air that is then drawn through a conventional bag filter in a canister. A small dirt-collecting tub that is removably mounted biaxially alongside the wand forms the cyclone dust-collecting device.

SUMMARY OF INVENTION

A vacuum cleaner comprises a housing, a module having a suction nozzle opening for cleaning a surface, a filter removably mounted to the housing, a working air conduit between the suction nozzle and the filter; a suction source mounted to the housing and in communication with the suction nozzle and the filter for moving dust-laden air between the suction nozzle and through the filter, a cyclonic dust separator mounted in the working air conduit upstream of the filter for separating larger particles from the dust-laden air before the dust-laden air passes through the filter, the cyclonic separator comprising a housing that forms a cyclonic chamber with an inlet opening and an outlet opening both of which are connected to the working air conduit, a dirt collecting tub removably mounted to the housing and forming a portion of the cyclonic chamber. The cyclonic dust separator further includes an exhaust conduit in communication with the outlet opening and that extends into the dirt collecting tub. According to the invention, the exhaust conduit is formed by an imperforate tube that has an open bottom end through which air passes from the cyclonic chamber to the outlet opening.

In one embodiment, an annular dirt blocking plate is mounted to a bottom portion of the exhaust conduit. Further, the annular dirt blocking plate is preferably conical in shape and is removably mounted to the cyclone exhaust conduit. In an alternate embodiment, a relatively small rod extends from the annular dirt blocking plate to a bottom portion of the dirt-collecting tub. Further, the annular dirt blocking plate extends laterally of the exhaust conduit.

In one embodiment, the housing is a canister and the filter is a bag filter that is mounted in the canister. In another embodiment, the housing is an upright handle that is pivotally mounted to the module for pivotal movement about a pivot axis between an upright stored position and a reclining use position.

Preferably, the working air conduit is formed in part by a rigid elongated tube that forms a portion of the handle and that extends between the base module at a lower end and the filter bag at an upper end.

The filter bag is typically a conventional filter bag that is removably mounted to an upper portion of the elongated tube. The soft porous bag is mounted to the handle. Alternately, the filter bag can be enclosed in a hard body housing in a clean air system.

In one embodiment, the suction source is mounted in the working air conduit between the suction nozzle and the cyclonic dust separator. In another embodiment, the suction source is mounted in the working air conduit downstream of the filter bag.

In yet another embodiment, the suction source is mounted in the working air conduit between the cyclonic dust separator and the filter bag.

BRIEF DESCRIPTION OF DRAWINGS

FIG. 3 is a cross-sectional view of the cyclone separator of FIGS. 1 and 2.

FIG. 3A is an enlarged cross-sectional view of a sealing gasket for the cyclone separator of FIGS. 1–3.

DETAILED DESCRIPTION

Figure 1:
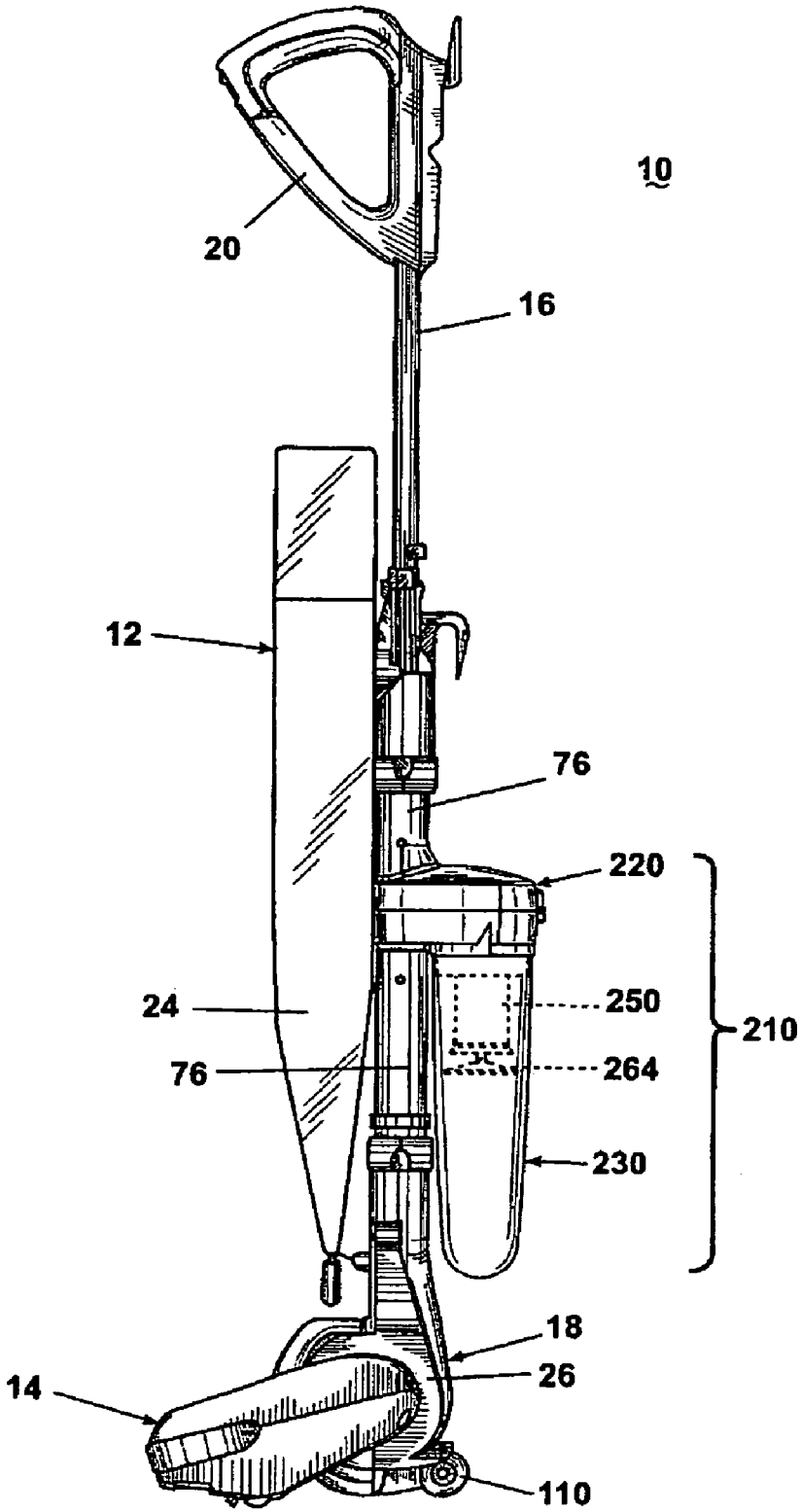
FIG. 1 is a side view of an upright vacuum cleaner with a cyclone separator according to the invention.

Referring to the drawings, and to FIG. 1 in particular, a cyclonic exhaust assembly forms a portion of an upright vacuum cleaner 10 comprising a handle assembly 12 pivotally mounted to a base module 14 carried in part by a wheel assembly 110. Handle assembly 12 includes an upper end 16 and a lower end 18. Upper end 16 comprises a hand grip 20. Handle assembly 12 is pivotally mounted to base module 14 at lower end 18, lower end 18 also preferably housing a suction source 26 fluidly connected to base module 14 for applying suction to a surface being cleaned, and further fluidly connected to a collection bag 24 carried by handle assembly 12. Base module 14 also houses an agitation brush in a suction opening applied to the surface being cleaned, commonly driven by the suction source. A working air conduit (not shown) extends between the suction opening and the suction source. Handle assembly 12 further comprises a tubular member 76 for fluidly connecting the suction source to the collection bag 24. The collection bag is a conventional soft bag filter in which a soft porous bag is mounted to the handle and houses a removable porous bag filter. The removable bag filter is in communication with an open upper end of the tubular member 76. The general form of the upright vacuum cleaner 10 is described in part in U.S. Pat. No. 6,256,833 issued Jul. 10, 2001, which is incorporated herein by reference in its entirety.

The tubular member 76 includes upper and lower portions connected by a cyclone body 220 of a cyclone separator 210. The cyclone separator 210 is thus fluidly interposed in the tubular member 76, which forms a part of the working air conduit, between the base module 14 and the collection bag 24. Cyclone body 220 diverts the fluid flow from the lower portion of tubular member 76, through cyclone separator 210, to the upper portion of tubular member 76, as illustrated in FIG. 3. Referring now to FIGS. 2–7, cyclone separator 210 includes a cyclone body 220 having first and second connecting tubes 211, 212 which are respectively connected to lower and upper portions of tubular member 76, a dirt-collecting tub 230 adapted to removably mount to the cyclone body 220, and a locking mechanism which removably suspends the dirt-collecting tub 230 from the cyclone body 220.

The first and second connecting tubes 211 and 212 of the cyclone body 220 are offset from the center of the cyclone body 220. With this construction, when the cyclone separator 210 is connected to the tubular member 76 of the cleaner, the center of the cyclone separator, and thus the central axis of the dirt-collecting tub 230, is placed laterally of the axis C1 of the tubular member 76 and in a laterally displaced axis C2, as shown in FIG. 3. Thus, there is no need to separate the tubular member 76 of the cleaner in order to remove the dirt-collecting tub 230 to discard the dirt collected therein.

The cyclone body 220 is divided into a lower body unit 221 which is united to the first connecting tube 211 and an upper body unit 222 which is united to the second connecting tube 212 and the upper and lower body units 222 and 221 are combined each to the other by a plurality of screws 229.

An air inlet 211*a* communicating with the first connecting tube 211 is formed at the lower body unit 221 and an air outlet 212*a* communicating with the second connecting tube 212 is formed at the upper body unit 222. Here, the air inlet 211*a* and the air outlet 212*a* are formed by dividing the insides of the upper and lower body units 222 and 221 by curved ribs 222*a* and 221*a*, respectively. In addition, several pairs of fixing bosses 222*b* and 221*b*, each having a screw hole at a predetermined position, are formed to face each other at the upper and lower body units 222 and 221. A positioning aperture 211*b* and a resiliently mounted detent 212*b* are formed at the first and second connecting tubes 211 and 212, respectively, for connecting the cyclone separator to the tubular member 76 and a resiliently mounted detent 203'*b* and a positioning aperture 203"*b*, which correspond to the positioning aperture 211*b* and the resiliently mounted detent 212*b*, are formed at the lower and upper portions of tubular member 76, respectively. Alternately, the cyclone separator can be connected to the tubular member 76 through a press fit connector.

The first connecting tube 211 is connected to the tubular member 76 nearer the base module 14 of the cleaner 10, and the second connecting tube 212 is connected to the tubular member 76 near the collection bag 24 of the cleaner 10. The dirty air drawn into the suction nozzle of the cleaner 10 and forced through tubular member 76 flows into the air inlet 211*a* of the first connecting tube 211 and in an oblique direction against the cyclone body 220, so that the whirlpool air current, shown as an arrow indicated by a solid line in FIG. 3, is generated inside of the cyclone body 220 and the dirt-collecting tub 230. By such a whirlpool air current, the debris contained in the air are separated from the air and fall to the bottom of tub 230 while the air is exhausted to the collection bag 24 of the cleaner 10 via the air outlet 212*a* of the cyclone body 220 and the upper tubular member 76, shown as an arrow indicated by a dotted line in FIG. 3.

Figure 2:
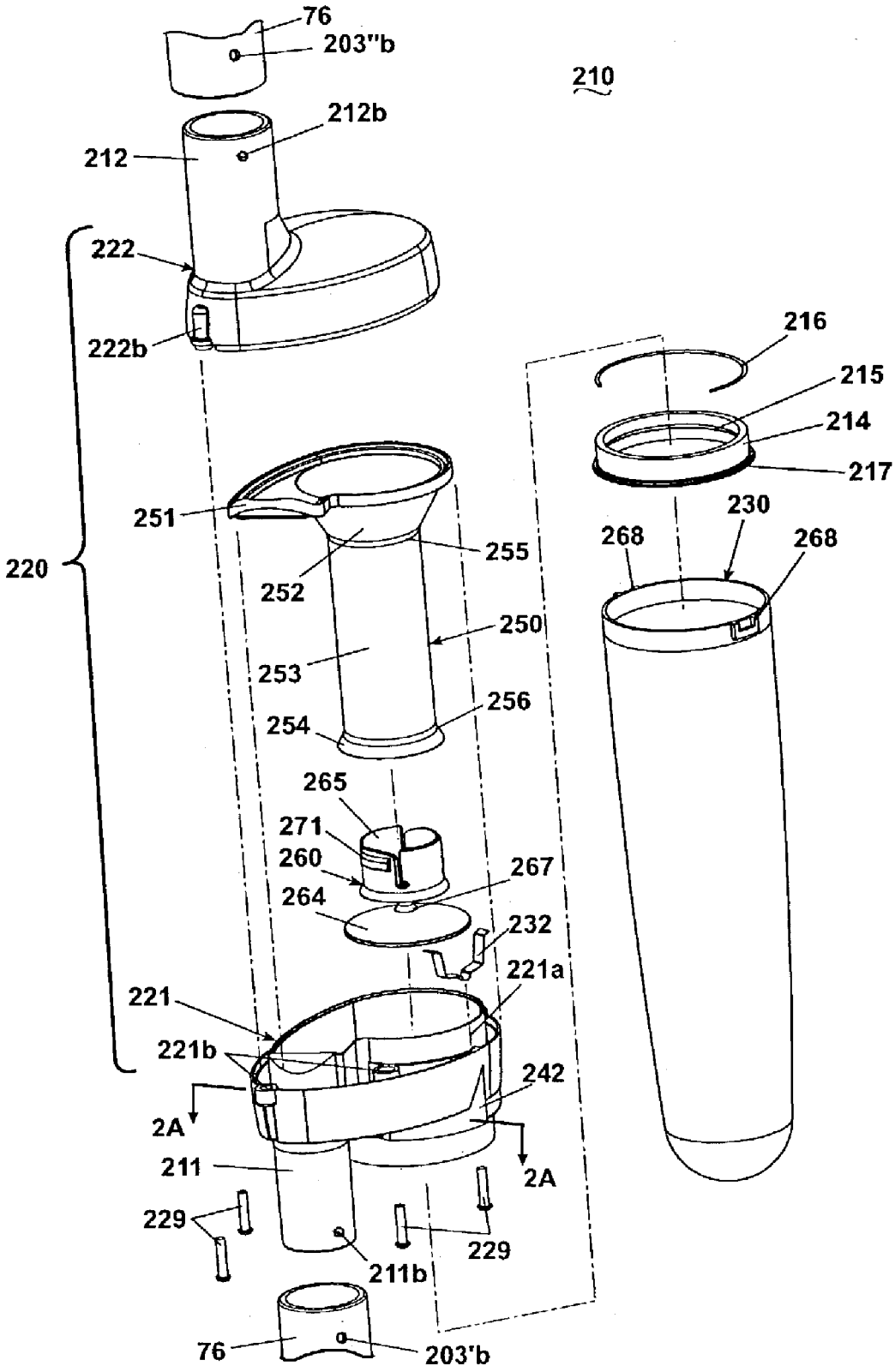
FIG. 2 is an exploded perspective view of the cyclone separator of FIG. 1.

As is best shown in FIG. 2, the dirt-collecting tub 230 is removably attached to the cyclone body 220 by the locking mechanism. Tub 230 serves to form the whirlpool air current together with the cyclone body 220 and to collect the dirt separated from the air with the centrifugal force by the whirlpool air current.

The dirt-collecting tub 230 is generally formed to be a cylinder shape, but the shape thereof may be varied. But, in consideration of the external appearance, it may be formed to be a tapering cylinder in which the diameter of the lower portion is smaller than that of the upper portion.

Further, in order to easily check the dirt collected inside of the dirt-collecting tub 230 from the outside, it is preferable that the dirt-collecting tub 230 is made of transparent or translucent material, but this is not intended to limit the material of construction of the dirt-collecting tub 230. Also, it is preferable that the dirt-collecting tub 230 is made of material which is lightweight and tough for ready handling and so that it cannot be easily broken from impact or by dropping.

Figure 2A:
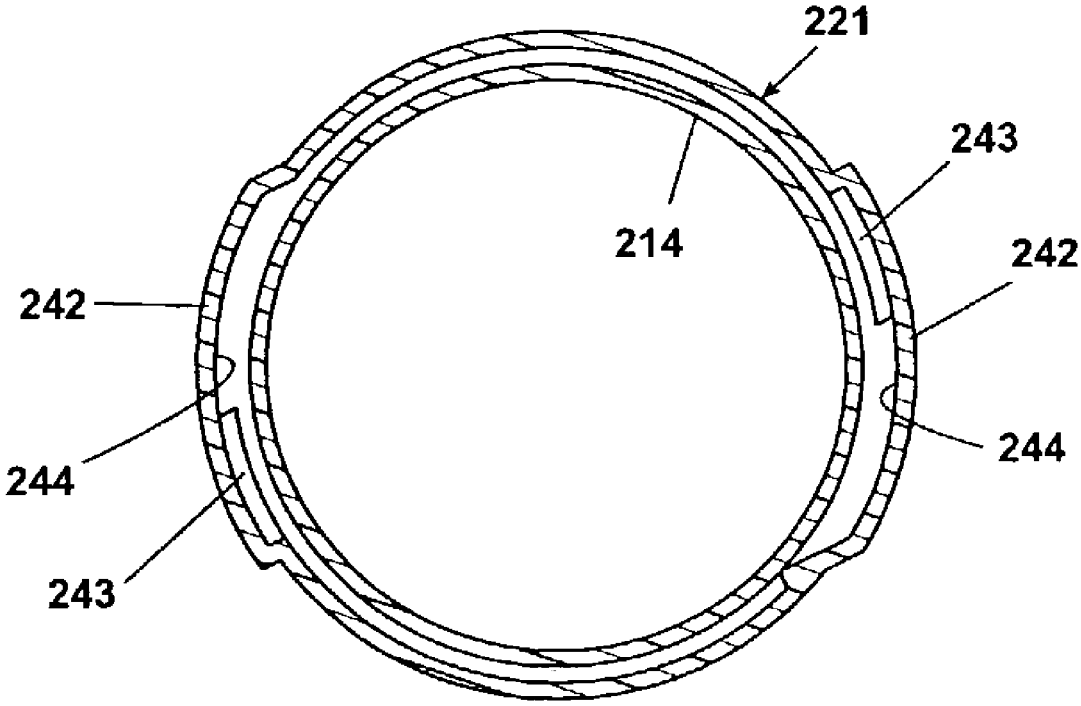
FIG. 2A is a partial sectional view taken along lines 2A—2A if FIG. 2.

The tub 230 is mounted to the supporting unit 221 through a bayonet twist and lock connection between the cyclone body 230 and the lower body unit 221. The twist and lock connection comprises a pair of radially projecting tabs 268 integrally formed on the outer surface of the tub 230 and diametrically opposite each other at the upper portion of the tub, and a pair of corresponding L-shaped slots 244 formed in the lower edge of the lower body unit 221. As shown in FIG. 2A, the slots have a shelf 243 to capture the tabs 268 when the tabs have entered the slots and the tub has been twisted into position over the shelves 243.

Referring to FIGS. 3 and 3A, a gasket 214 is provided inside air inlet 211*a* with a sealing edge 217 extending radially outwardly to engage the inner surface of tub 230. The gasket 214 serves to seal the tub 230 to prevent dust from escaping during operation of the vacuum cleaner. The gasket 214 is generally cylindrical and is formed with a circumferential groove 215 on its inner surface. The groove 215 is adapted to receive a spring ring 216. With the gasket in place in air inlet 211*a*, the spring ring 216 can be inserted into the groove 215 and is sized to exert an outward force on gasket 214. This outward force exerted by spring ring 216 on gasket 214 creates sufficient friction between gasket 214 and lower body unit 221 to prevent gasket 214 from being dislodged during removal of tub 230 from cyclone body 220.

Referring again to FIGS. 2–3, a cyclone outlet assembly 250 is attached to the cyclone body 220. The cyclone outlet assembly 250 serves to create a cyclone region between it and the dirt-collecting tub 230. Furthermore, the cyclone outlet assembly 250 serves to prevent dust and small debris captured in the dirt collecting tub 230 from flowing backward together with the air via the air outlet 212*a* of the cyclone body 220 when the cyclone separator is operated. The cyclone outlet assembly 250 extends downwardly from the air outlet 212*a*. Dirt separated from the air falls into the lower portion of the dirt-collecting tub 230. A U-shaped spring 232 is positioned between the top edge of the tub 230 and the lower body unit 221 to exert downward force on the tub and provide a detent that locks the tub in place relative to the body unit 221. To this end, the upper edge of the tub 230 has a small bump that forms a detent with the U-shaped spring 232.

Figure 4:
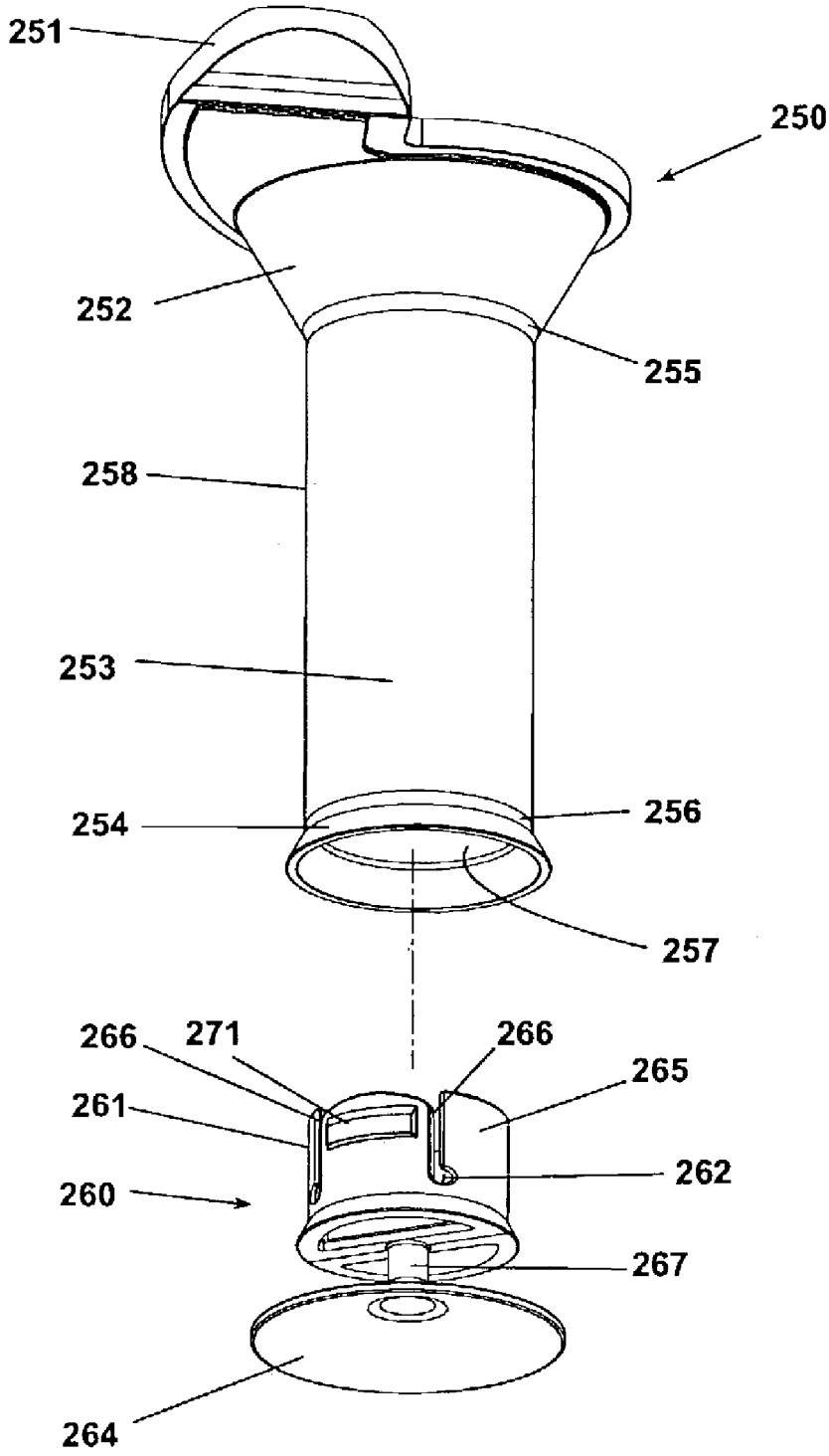
FIG. 4 is an exploded perspective view of a cyclone outlet assembly for the cyclone separator of FIGS. 1–3.
Figure 5:
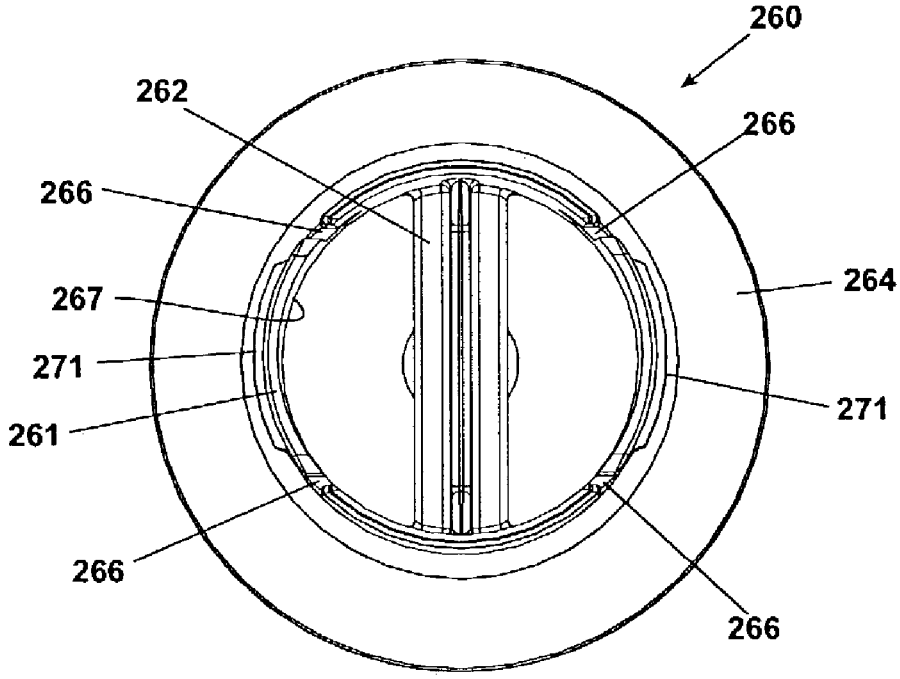
FIG. 5 is a top view of a flange insert assembly of the cyclone separator of FIGS. 1–4.
Figure 6:
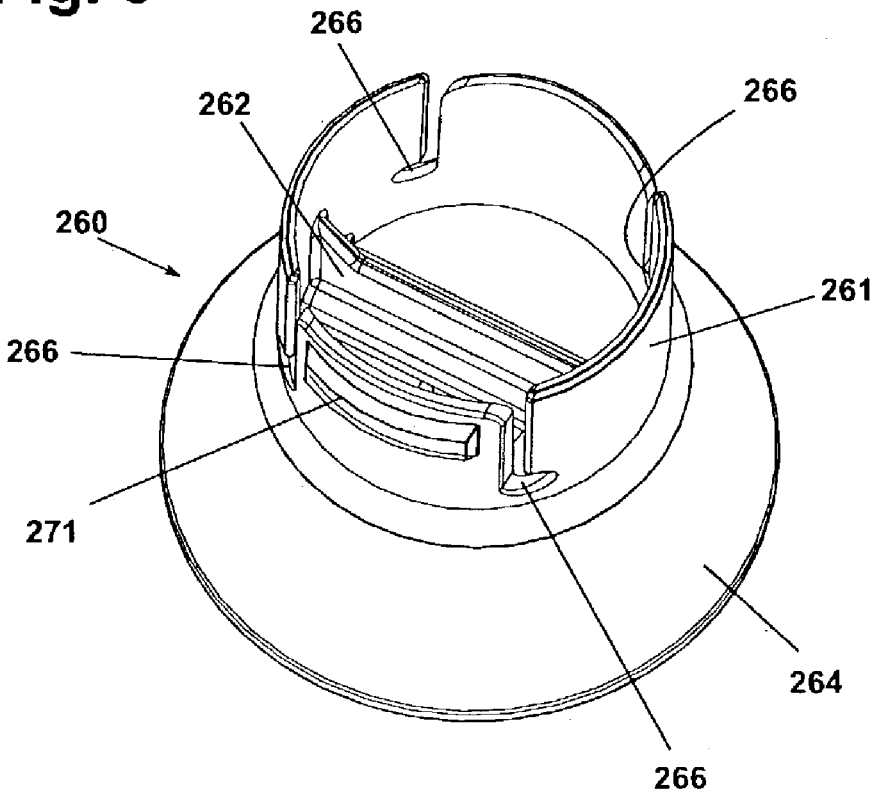
FIG. 6 is a perspective view of a flange insert assembly of the cyclone separator of FIGS. 1–4.

Referring to FIGS. 4–6, the cyclone outlet assembly 250 comprises an exhaust guide unit 251, a conical unit 252 the inside of which is hollow, a cylindrical tube 253, and a lower flange 254. The exhaust guide unit 251 is supported by the curve ribs 222*a* and 221*a* formed at the upper and lower body units 222 and 221, to position the cyclone outlet assembly 250. A rib groove 251*a* for receiving the curve rib 222*a* of the upper body unit 222 is formed at the edge of the upper surface of the exhaust guide unit 251 and an end jaw unit 251*b* to which the curve rib 221*a* of the lower body unit 221 is closely mounted is formed at the outer surface thereof.

The cylindrical tube 253 has a first end 255, a second end 256, an inner wall 257, and an outer wall 258. The first end 255 is in communication with the conical unit 252 and the second end 256 is in communication with the lower flange 254. The lower flange 254 flares outwardly and downwardly in an annular fashion. The cyclone outlet assembly 250 creates an air path thorough its center and follows a path from the lower flange 254, through the cylindrical tube 253, through the conical unit 252, further communicating with the exhaust guide unit 251.

Referring to FIGS. 4–6, a flange insert assembly 260, includes a flange tube 261, a centering support 262, and a frusto-conical dirt-blocking plate 264. The flange tube 261 comprises a cylindrical wall 265 with four vertical slots 266 that define flexible flanges in the upper portion of the wall 265. The centering support 262 extends across a bottom portion of the wall 265 and supports a depending center support rod 267. The dirt-blocking plate 264 is mounted to the center support rod 267 that extends perpendicularly from the center of the dirt blocking plate 264 to the centering support 262. The flange insert assembly 260 is removably mounted in the cyclone outlet assembly 250. The inside surface of the flange tube 261 has a raised cylindrical surface at a lower portion thereof and the outer surface of the cylindrical wall 265 of the flange tube 261 has a pair of embossments 271 that form a detent mechanism to releasably retain the flange tube 261 in the cylindrical tube 253. Alternately, the flange tube 251 can be mounted in the inner wall 257 of the cylindrical tube 253 through a friction fit. The flange insert assembly 260 is positioned within the tube 253 to leave an air space between the dirt blocking plate 264 and the lower flange 254 for passage of cleaner air therethrough and into the cylindrical tube 253.

The dirt-blocking plate 264 serves to block dirt from rising together with the air before the dirt reaches the cylindrical tube 253, causing the dirt to fall again. Accordingly, debris is restrained from rising to the upper portion of the cyclone body 220 but is blocked to fall again, so that the quantity of the dirt reaching the cylindrical tube 253 is significantly reduced.

Figure 1A:
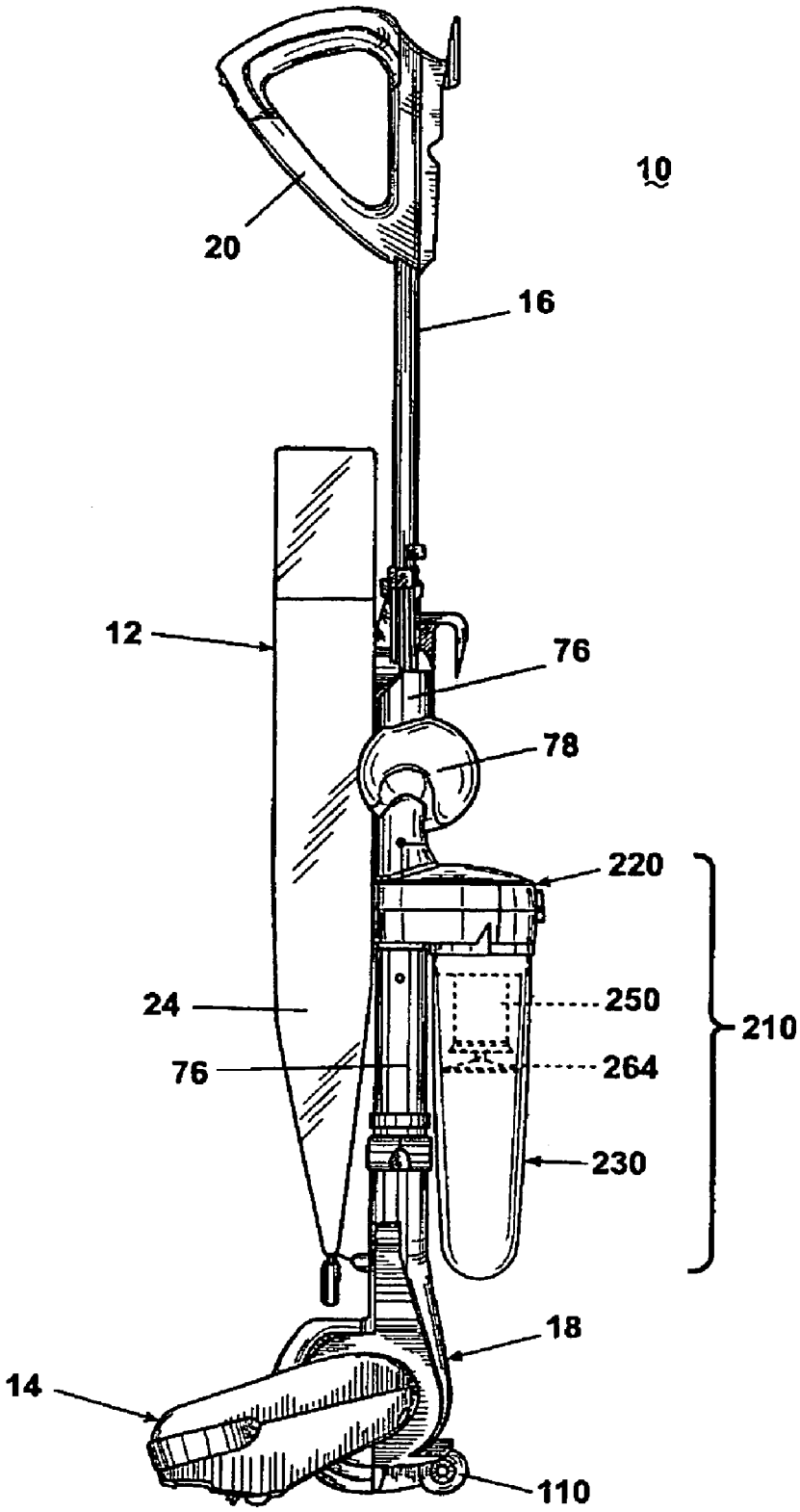
FIG. 1A is a side view, like FIG. 1, of an upright vacuum cleaner with a cyclone but illustrating a modified form of the invention.

Referring to FIG. 1A, where like numerals are used to designate like parts, an upright vacuum cleaner has a suction source 78 in the tubular member 76 between the cyclone separator 210 and the collection bag 24.

Figure 7:
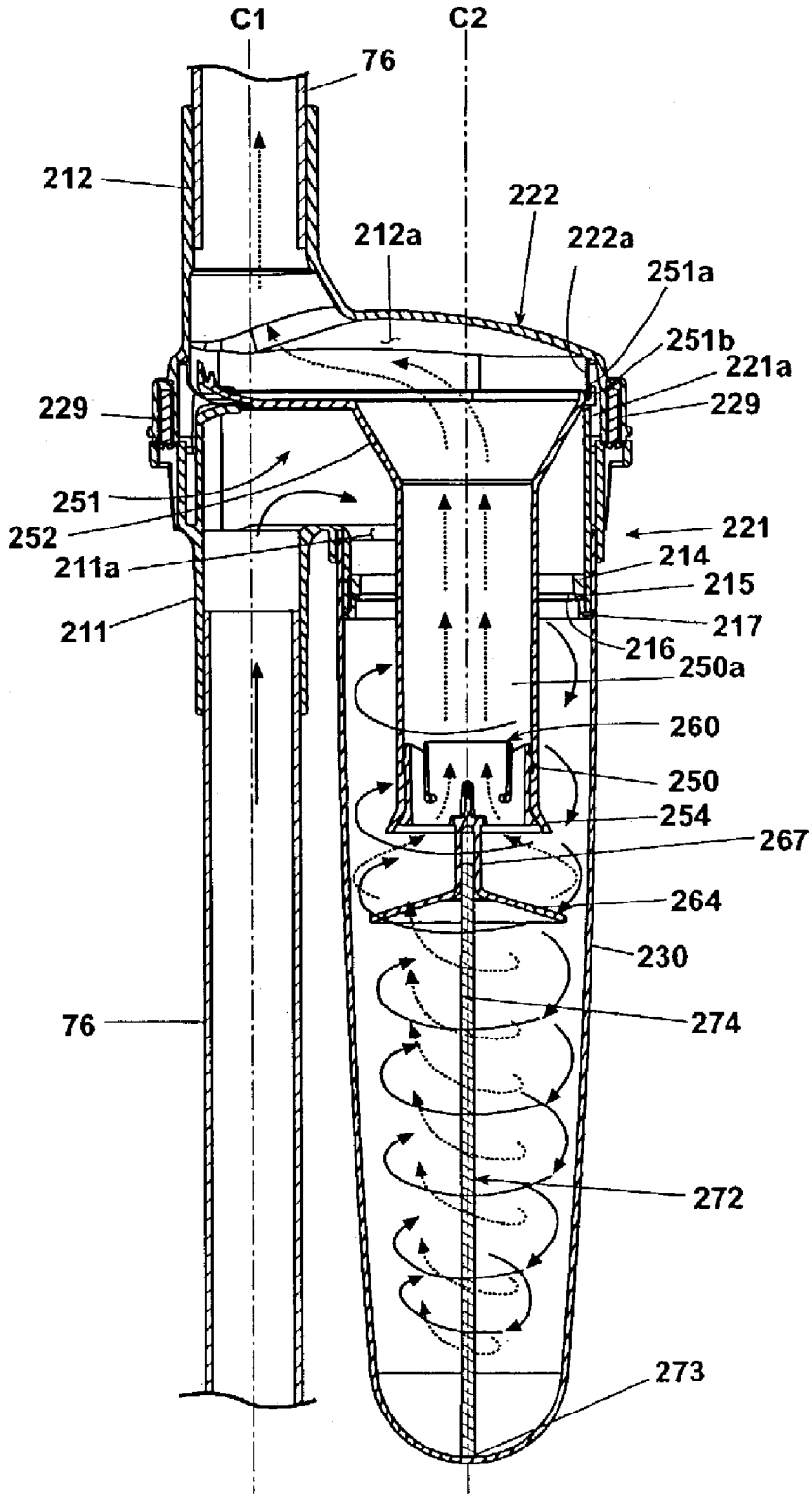
FIG. 7 is a cross-sectional view of an alternate embodiment of a flange insert assembly and center post of the cyclone separator of FIGS. 1–3.

In yet another alternate embodiment shown in FIG. 7, the support rod 267 is extended so that there is an increased offset between the lower flange 254 and the dirt blocking plate 264. A center post 272, comprising a first end 273 and a second end 274, is attached at its first end 273 to the inner surface of the dirt tub 230. The center post 272 is centered in and aligned axially with the dirt tub 230. The center post 272 is of sufficient length so that the second end 274 touches or is at least in close proximity to the bottom of the dirt blocking plate 264 when the dirt tub 230 is mated to the cyclone body.

Figure 8:
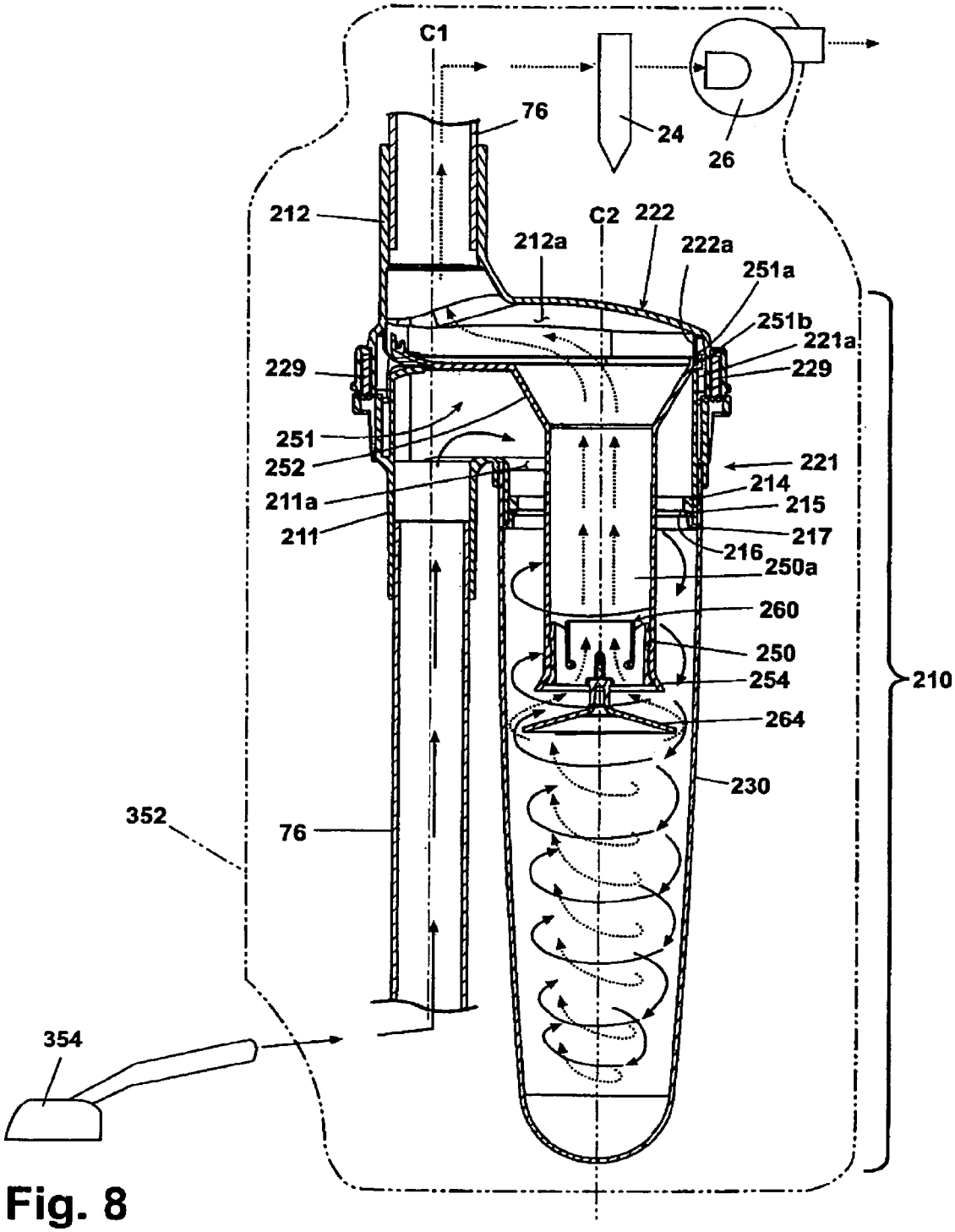
FIG. 8 is a schematic view of an alternate embodiment of the invention.

Referring now to FIG. 8 where like numbers are used to describe like parts, a canister 352 forms a housing for the cyclone separator 210, the suction source 26 and the collection bag 24. The tube 76 is connected to a suction nozzle 354, which typically is manipulated by a wand in a conventional canister suction cleaner.

Hereinafter, a description will be made on the operation of the vacuum cleaner 10 having the cyclone separator 210 as described above. With electric power supplied, the suctioning force is produced by the driving of the suction source of the cleaner 10. Then, the dirt enters the inside of the cyclone separator via the suction opening and the first connecting tube 211 together with the suction air, as shown in FIG. 3. In this case, the air which enters the cyclone separator flows in a slanting direction against the cyclone body 220 by the air inlet 211*a* of the first connecting tube 211.

Accordingly, the air produces a cyclonic air current and is directed to the lower portion of the dirt-collecting tub 230. In this process, debris contained in the air is separated from the air by the centrifugal force and descends along the inner side wall of the dirt-collecting tub to be collected at the dirt-collecting tub 230. As the rising air current is rotated with a smaller radius, the air reverses and rises from the lower portions of the dirt-collecting tub 230 and is exhausted to the collection bag 24 of the cleaner 10 via the air outlet 212*a* and the second connecting tube 212. In this case, any dirt rising together with the air does not enter the cyclone outlet assembly 250 and is collected at the dirt-collecting tub 230.

The dust-collecting process performed in the collection bag 24 is well known in the art. As the dirt-collecting tub 230 is filled with the dirt that has been separated from the airflow, the collected dirt is removed by separating only the dirt-collecting tub 230 from the cyclone body 220 without separating the cyclone separator from the extension pipe. This dirt is thus removed from the air stream upstream of the collection bag 24. By greatly decreasing the quantity of dirt that reaches the filter bag, the life of the filter bag is substantially increased, reducing the frequency of emptying and replacing the filter bag. The dirt in tub 230 is easy to observe, and tub 230 can be easily removed and emptied by the user without creating the cloud of dust so familiar to the user who has replaced filter bags.

As described in the above embodiments, since the dirt and debris contained in the dirty airflow are primarily collected by the cyclone separator, the present invention can remarkably reduce the quantity of the dirt collected at the collection bag 24 of the cleaner 10. Therefore, it is possible to extend the period for replacing or servicing the collection bag 24.

In addition, when the dirt-collecting tub 230 of the cyclone separator is filled with dirt, the dirt can be removed by simply separating the dirt-collecting tub 230 from the cyclone body 220 without removing the cyclone separator 210 from the cleaner 10.

Whereas the invention has been described with respect to a dirty air system in which dirty air is drawn through a suction motor before passing through the cyclone separator 210, the invention also includes a clean air system in which the suction motor draws air through the cyclone separator 210 and the collection bag 24. Alternatively, the suction motor can be positioned between the cyclone separator 210 and the collection bag 24 within the scope of the invention. While particular embodiments of the invention have been shown, it will be understood that the invention is not limited thereto. For example, the invention has been described with respect to a particular type of upright vacuum cleaner. The invention also includes vacuum cleaners of other designs in which the cyclone separator disclosed herein is used upstream from a bag filter, or even when other types of filters are used. Thus, the invention, in its broader aspects includes canister vacuum cleaners as well as upright vacuum cleaners of all types in which the cyclone separator described above is included upstream of a filter. Reasonable variation and modification are possible within the scope of the foregoing disclosure and drawings, particularly in light of the foregoing teachings, without departing from the spirit of the invention which is defined in the appended claims.

The invention claimed is:

1. A vacuum cleaner comprising:

a housing;

a module having a suction nozzle opening for cleaning a surface;

a filter removably mounted to the housing;

a working air conduit between the suction nozzle and the filter; and a suction source mounted to the housing and in communication with the suction nozzle and the filter for moving dust-laden air between the suction nozzle and through the filter;

a cyclonic dust separator mounted in the working air conduit upstream of the filter for separating larger particles from the dust-laden air before the dust-laden air passes through the filter, the cyclonic separator comprising a cyclone housing that forms a cyclonic chamber with an inlet opening and an outlet opening both of which are connected to the working air conduit, a dirt collecting tub removably mounted to the cyclone housing; and the cyclonic dust separator further includes an exhaust conduit in communication with the outlet opening and that extends into the dirt collecting tub, the exhaust conduit forming with the dirt collecting tub an annular region for cyclonic airflow around the exhaust conduit;

the improvement which comprises:

the exhaust conduit is formed by an imperforate tube that has an open bottom end through which air passes from the cyclonic chamber to the outlet opening; and an dirt blocking plate mounted to a bottom portion of the exhaust conduit and positioned axially below the open bottom end of the imperforate tube.

2. The vacuum cleaner according to claim 1 and further comprising a relatively small rod extending from the dirt blocking plate to a bottom portion of the dirt collecting tub.

3. The vacuum cleaner according to claim 1 wherein the dirt blocking plate extends laterally of the exhaust conduit.

4. The vacuum cleaner of claim 1 wherein the housing is a canister and the filter is a bag filter that is mounted in the canister.

5. The vacuum cleaner of claim 1 wherein the housing is an upright handle that is pivotally mounted to the module for pivotal movement about a pivot axis between an upright stored position and a reclining use position.

6. The vacuum cleaner according to claim 5 and further comprising a twist and lock connection for removably suspending the dirt-collecting tub from the cyclone separator housing.

7. A vacuum cleaner according to claim 1 wherein the suction source is mounted in the working air conduit downstream of the filter bag.

8. A vacuum cleaner comprising:

a housing;

a module having a suction nozzle opening for cleaning a surface;

a filter removably mounted to the housing;

a working air conduit between the suction nozzle and the filter; and a suction source mounted to the housing and in communication with the suction nozzle and the filter for moving dust-laden air between the suction nozzle and through the filter;

a cyclonic dust separator mounted in the working air conduit upstream of the filter for separating larger particles from the dust-laden air before the dust-laden air passes through the filter, the cyclonic separator comprising a cyclone housing that forms a cyclonic chamber with an inlet opening and an outlet opening both of which are connected to the working air conduit, a dirt collecting tub removably mounted to the cyclone housing; and the cyclonic dust separator further includes an exhaust conduit in communication with the outlet opening and that extends into the dirt collecting tub;

the improvement which comprises:

the exhaust conduit is formed by an imperforate tube that has an open bottom end through which air passes from the cyclonic chamber to the outlet opening and dirt blocking plate is removably mounted to a bottom portion of the cyclone exhaust conduit in spaced relationship axially below the open bottom end thereof.

9. The vacuum cleaner according to claim 8 and further comprising a relatively small rod extending from the dirt blocking plate to a bottom portion of the dirt-collecting tub.

10. The vacuum cleaner according to claim 9 wherein the dirt blocking plate extends laterally of the exhaust conduit.

11. A vacuum cleaner comprising:

a housing;

a module having a suction nozzle opening for cleaning a surface;

a filter removably mounted to the housing;

a working air conduit between the suction nozzle and the filter; and a suction source mounted to the housing and in communication with the suction nozzle and the filter for moving dust-laden air between the suction nozzle and through the filter;

a cyclonic dust separator mounted in the working air conduit upstream of the filter for separating larger particles from the dust-laden air before the dust-laden air passes through the filter, the cyclonic separator comprising a cyclone housing that forms a cyclonic chamber with an inlet opening and an outlet opening both of which are connected to the working air conduit, a dirt collecting tub removably mounted to the cyclone housing; and the cyclonic dust separator further includes an exhaust conduit in communication with the outlet opening and that extends into the dirt collecting tub, the exhaust conduit forming with the dirt collecting tub an annular region for cyclonic airflow around the exhaust conduit;

the improvement which comprises:

the exhaust conduit comprises an imperforate tube that has an open bottom end through which air passes from the cyclonic chamber to the outlet opening;

the housing comprises an upright handle that is pivotally mounted to the module for pivotal movement about a pivot axis between an upright stored position and a reclining use position; and the filter is a filter bag that is removably mounted to the handle for movement therewith.

12. A vacuum cleaner according to claim 11 wherein the working air conduit is formed in part by a rigid elongated tube that forms a portion of the handle and that extends between the base module at a lower end and the filter bag at an upper end.

13. The vacuum cleaner according to claim 12 wherein the cyclonic separator inlet opening is connected to the rigid elongated tube upstream from the outlet opening.

14. The vacuum cleaner according to claim 13 wherein the outlet opening of the cyclonic separator is also connected to the rigid elongated tube and the cyclonic separator is connected to the rigid elongated tube intermediate the ends thereof.

15. The vacuum cleaner according to claim 11 wherein the filter bag is a conventional filter bag that is mounted in a soft porous bag that is removably mounted to an upper portion of the elongated tube.

16. The vacuum cleaner according to claim 15 wherein the soft porous bag is mounted to the handle.

17. A vacuum cleaner comprising:

a housing;

a module having a suction nozzle opening for cleaning a surface;

a filter removably mounted to the housing;

a working air conduit between the suction nozzle and the filter; and a suction source mounted to the housing and in communication with the suction nozzle and the filter for moving dust-laden air between the suction nozzle and through the filter;

a cyclonic dust separator mounted in the working air conduit upstream of the filter for separating larger particles from the dust-laden air before the dust-laden air passes through the filter, the cyclonic separator comprising a cyclone housing that forms a cyclonic chamber with an inlet opening and an outlet opening both of which are connected to the working air conduit, a dirt collecting tub removably mounted to the housing cyclone; and the cyclonic dust separator further includes an exhaust conduit in communication with the outlet opening and that extends into the dirt collecting tub;

the improvement which comprises:

the exhaust conduit is formed by an imperforate tube that has an open bottom end through which air passes from the cyclonic chamber to the outlet opening;

wherein the suction source is mounted in the working air conduit between the suction nozzle and the cyclonic dust separator.

18. A vacuum cleaner comprising:

a housing;

a module having a suction nozzle opening for cleaning a surface;

a filter removably mounted to the housing;

a working air conduit between the suction nozzle and the filter; and a suction source mounted to the housing and in communication with the suction nozzle and the filter for moving dust-laden air between the suction nozzle and through the filter;

a cyclonic dust separator mounted in the working air conduit upstream of the filter for separating larger particles from the dust-laden air before the dust-laden air passes through the filter, the cyclonic separator comprising a cyclone housing that forms a cyclonic chamber with an inlet opening and an outlet opening both of which are connected to the working air conduit, a dirt collecting tub removably mounted to the cyclone housing; and the cyclonic dust separator further includes an exhaust conduit in communication with the outlet opening and that extends into the dirt collecting tub;

the improvement which comprises:

the exhaust conduit is formed by an imperforate tube that has an open bottom end through which air passes from the cyclonic chamber to the outlet opening;

wherein the suction source is mounted in the working air conduit between the cyclonic dust separator and the filter bag.

* * * * *